US007010932B2

(12) United States Patent
Kuroyanagi et al.

(10) Patent No.: US 7,010,932 B2
(45) Date of Patent: Mar. 14, 2006

(54) ICE DISCHARGING MECHANISM PART OF ICE STORAGE CHAMBER

(75) Inventors: Masayuki Kuroyanagi, Aichi (JP); Takashi Hibino, Aichi (JP); Hiroshi Torimitsu, Aichi (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 290 days.

(21) Appl. No.: 10/416,289

(22) PCT Filed: Aug. 12, 2002

(86) PCT No.: PCT/JP02/08216

§ 371 (c)(1),
(2), (4) Date: May 9, 2003

(87) PCT Pub. No.: WO03/016797

PCT Pub. Date: Feb. 27, 2003

(65) Prior Publication Data

US 2004/0035137 A1 Feb. 26, 2004

(30) Foreign Application Priority Data

Aug. 13, 2001 (JP) ..... 2001-245395

(51) Int. Cl.
*F25C 5/18* (2006.01)

(52) U.S. Cl. ..... 62/344; 222/504; 251/129.2

(58) Field of Classification Search ..... 62/344; 222/504; 251/129.2
See application file for complete search history.

(56) References Cited

U.S. PATENT DOCUMENTS

| | | | | |
|---|---|---|---|---|
| 3,905,523 | A * | 9/1975 | Ahlers et al. | 222/504 |
| 4,346,824 | A * | 8/1982 | Miller et al. | 222/504 |
| 5,279,445 | A * | 1/1994 | Fisher et al. | 222/1 |
| 5,799,825 | A * | 9/1998 | Dillman | 222/1 |
| 5,829,646 | A * | 11/1998 | Schroeder et al. | 222/241 |
| 6,009,718 | A | 1/2000 | Ikari et al. | 62/354 |
| 6,188,029 | B1 * | 2/2001 | Miyamoto et al. | 177/105 |

FOREIGN PATENT DOCUMENTS

| | | |
|---|---|---|
| JP | 2000-179004 | 6/2000 |
| KR | 2000-28916 | 5/2000 |

* cited by examiner

*Primary Examiner*—William E. Tapolcai
(74) *Attorney, Agent, or Firm*—Wenderoth, Lind & Ponack, L.L.P.

(57) ABSTRACT

An ice discharging mechanism for an ice storage box including a swinging solenoid (24) mounted by means of a swing shaft (23) fixed onto arm portions (22) of a bracket (21). A support plate (27) is welded onto a lower part of the bracket (21). One end of a plunger (33) and one end of a link member (34) are coupled with each other by means of a coupling shaft (31) inserted through a long hole (29) of the support plate (27). In a lower end portion of the bracket (21), a pivoting plate (37) that forms an opening/closing door is pivotably mounted to a fulcrum shaft (35) that is provided parallel to the swing shaft (23). A moving shaft (41) provided at the other end of the link member (34) is inserted through the pivoting plate (37) whereby the plunger (33) and the pivoting plate (37) are connected with each other.

6 Claims, 8 Drawing Sheets

ICE DISCHARGING MECHANISM PART OF ICE STORAGE CHAMBER

BACKGROUND OF THE INVENTION

1. Technical Field

This invention relates to an ice discharging mechanism of an ice storage box, in particular a mounting structure for a solenoid that pivots an opening/closing door of an ice discharge port.

2. Description of the Related Art

FIG. 6 is an exploded view of a conventional ice discharging mechanism provided in an ice storage box of an ice making machine. A solenoid 2 is screwed onto a bracket 1 that is fixed onto an outer wall surface of the ice storage box. A pivoting plate 4 is pivotably mounted by means of a fulcrum shaft 3 to a lower end portion of the bracket 1. A sealing rubber plate 5 for plugging an ice discharge port formed in the ice storage box is fixed to the pivoting plate 4. One end of a link member 8 is connected to a plunger 6 of the solenoid 2 by means of a coupling shaft 7, and the other end of the link member 8 is connected to the pivoting plate 4 by means of a moving shaft 9. The coupling shaft 7 is fitted with play to long holes 11 of a support plate 10 that is fixed onto the bracket 1 and is slidably supported. Further, to the moving shaft 9, there are mounted springs 12 for urging the pivoting plate 4 so as to allow the sealing rubber plate 5 to plug the ice discharge port.

FIG. 7 is a partially cutaway front view of an assembled ice discharging mechanism.

As indicated by solid lines in FIG. 8, in the extended state of the plunger 6 of the solenoid 2, the pivoting plate 4 is urged by the springs 12 so that the sealing rubber plate 5 plugs an ice discharging port 13. As indicated by alternate long and two short dashes lines, when the plunger 6 of the solenoid 2 is contracted, the moving shaft 9 is lifted upward through the link member 8 and the pivoting plate 4 is caused to pivot obliquely upward about the fulcrum shaft 3. Thus, the sealing rubber plate 5 is moved apart from the ice discharge port 13 so that the ice discharge port 13 is opened to allow ice within the ice storage box to be discharged.

However, conventionally, the support plate 10 by which the coupling shaft 7 of the plunger 6 is slidably supported is welded onto the bracket 1 and the solenoid 2 is screwed onto the bracket 1, with the result that shaft misalignment between the bracket 1 and the solenoid 2, and shaft misalignment between the solenoid 2 and the plunger 6 as well as the link member 8 are liable to occur due to welding distortion and mounting backlash. In general, the clearance between the solenoid 2 and the plunger 6 is very strictly defined, so that occurrence of such shaft misalignments prohibits smooth operation of the plunger 6 so that an overload is applied to the solenoid 2. In addition, the shaft misalignments cause a large frictional force to be generated in locations where sliding contact occurs among the respective members, which may result in such disadvantages as wear, galling, and rusting.

As a result, there are such problems as difficulty in achieving stable operation of the ice discharging mechanism and reduced service life.

SUMMARY OF THE INVENTION

The present invention has been made to solve the above-mentioned problems, and therefore an object thereof is to provide an ice discharging mechanism of an ice storage box which allows stable operation to be performed and helps to promote extended service life.

An ice discharging mechanism of an ice storage box in accordance with the present invention includes: a bracket fixed near an ice discharge port of the ice storage box; an opening/closing door pivotably mounted to the bracket; a swing shaft mounted to the bracket; and a swinging solenoid mounted to the swing shaft and having a plunger that is capable of advancing/retracting, which pivots the opening/closing door by means of the advancing/retracting operation of the plunger to selectively open/close the ice discharge port of the ice storage box.

Note that the solenoid can be so mounted as to be slidable by a predetermined distance along the axial direction of the swing shaft. More preferably, the ice discharging mechanism includes: a link member for coupling the forward end portion of the plunger to the opening/closing door; and a support plate fixed to the bracket and slidably supporting a coupling shaft that couples the forward end portion of the plunger to the link member, in which the predetermined distance that the solenoid can slide is made equal to or smaller than the distance that the plunger can move along the coupling shaft.

Further, it is preferable that the diameter of the forward end portion of the plunger which is to be coupled to the link member be made larger than the diameter of the remaining portion of the plunger.

It is also possible to cover the front portion of the support plate with a cover member.

The opening/closing door may be so constructed as to include a pivoting plate that is pivotably mounted to the bracket and a sealing rubber plate fixed to the pivoting plate for plugging the ice discharge port of the ice storage box. Further, it is preferable that the pivoting plate be urged by a spring such that the sealing rubber plate plugs the ice discharge port of the ice storage box.

DETAILED DESCRIPTION OF THE INVENTION

Hereinbelow, an embodiment of the present invention will be described based on the accompanying drawings.

Figure 1:
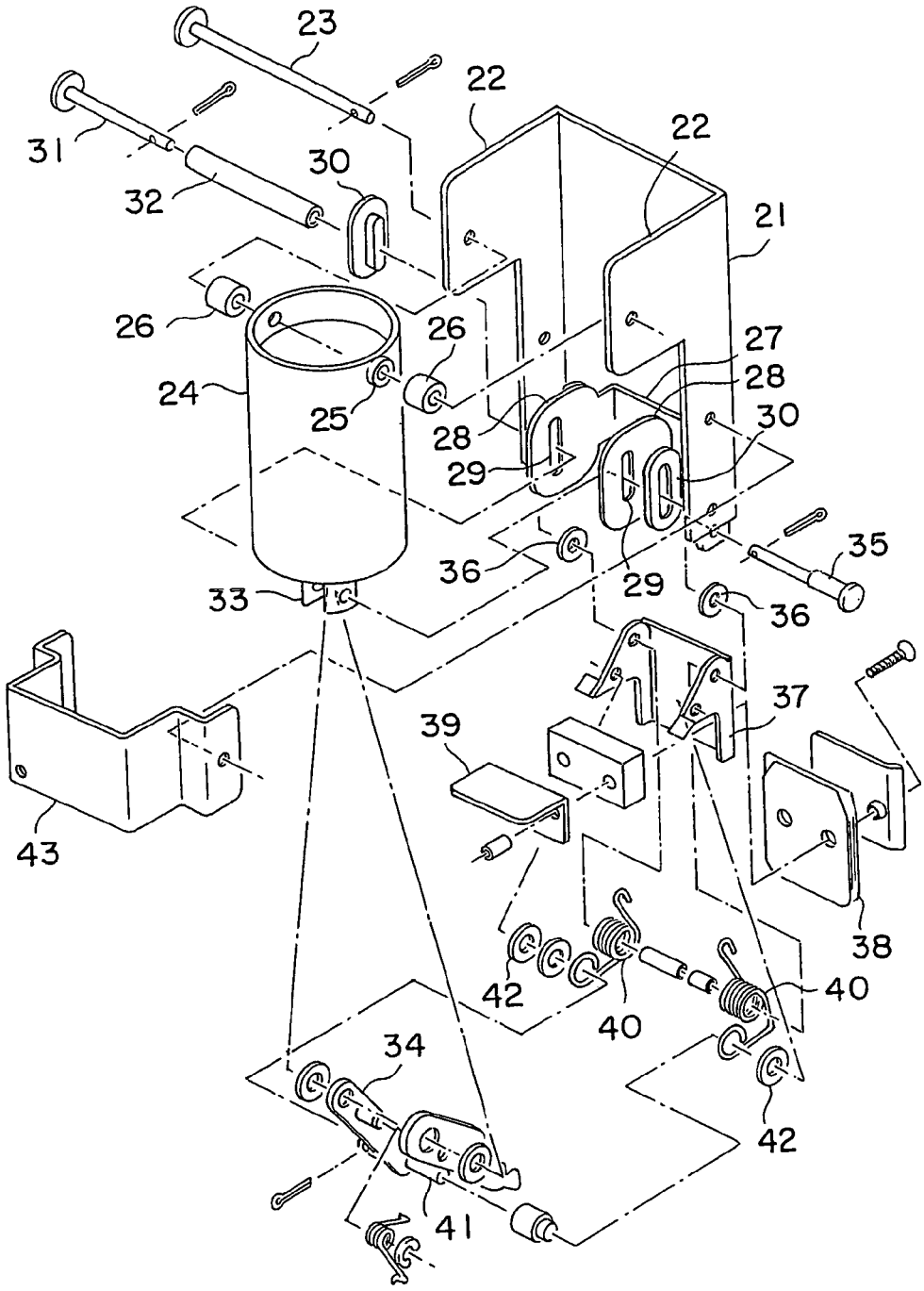
FIG. 1 is an exploded view showing an ice discharging mechanism of an ice storage box in accordance with an embodiment of the present invention.

FIG. 1 shows an exploded view of an ice discharging mechanism of an ice storage box in accordance with an embodiment of the present invention. A bracket 21 is fixed with screws onto an outer wall surface of the ice storage box. The bracket 21 has in an upper part thereof a pair of mutually opposing right and left arm portions 22, and a swing shaft 23 is inserted through the arm portions 22 to be fixed thereby. Between the pair of arm portions 22, a solenoid 24 is mounted so as to be able to swing by means of the swing shaft 23. The swing shaft 23 is supported by a bearing 25 mounted to the solenoid 24. Spacers 26 are respectively inserted between the solenoid 24 and the pair of arm portions 22.

The bracket 21 has a support plate 27 welded onto a lower part thereof. The support plate 27 has a pair of mutually opposing right and left arm portions 28, and a long hole 29 is formed in each of the arm portions 28. A coupling shaft 31 is inserted through the long holes 29 by way of a bearing 30, and at the same time, the coupling shaft 31 is covered with a tubular lubricating member 32 so that the coupling shaft 31 is mounted so as to be slidable along the long holes 29 together with the lubricating member 32. Between the pair of arm portions 28, the coupling shaft 31 and the lubricating member 32 penetrate through one end of each of a plunger 33 of the solenoid 24 and a link member 34 whereby the plunger 33 and the link member 34 are coupled with each other.

In a lower end portion of the bracket 21, a fulcrum shaft (pivoting shaft) 35 is provided parallel to the swing shaft 23. A pivoting plate 37 is pivotably mounted to the fulcrum shaft 35 through a bearing 36. A sealing rubber plate 38 for plugging an ice discharge port formed in the ice storage box and a patch 39 are fixed to the pivoting plate 37. The pivoting plate 37, the sealing rubber plate 38, and the patch 39 together form an opening/closing door. Mounted to the fulcrum shaft 35 are springs 40 for urging the pivoting plate 37 so as to allow the sealing rubber plate 38 to plug the ice discharge port. A moving shaft 41 provided at the other end of the link member 34 is inserted through the pivoting plate 37 by way of bearings 42, so that the plunger 33 is connected to the pivoting plate 37 by means of the link member 34.

Further, a cover member 43 is mounted to the bracket 21 so as to cover the front portion of the support plate 27.

Figure 2:
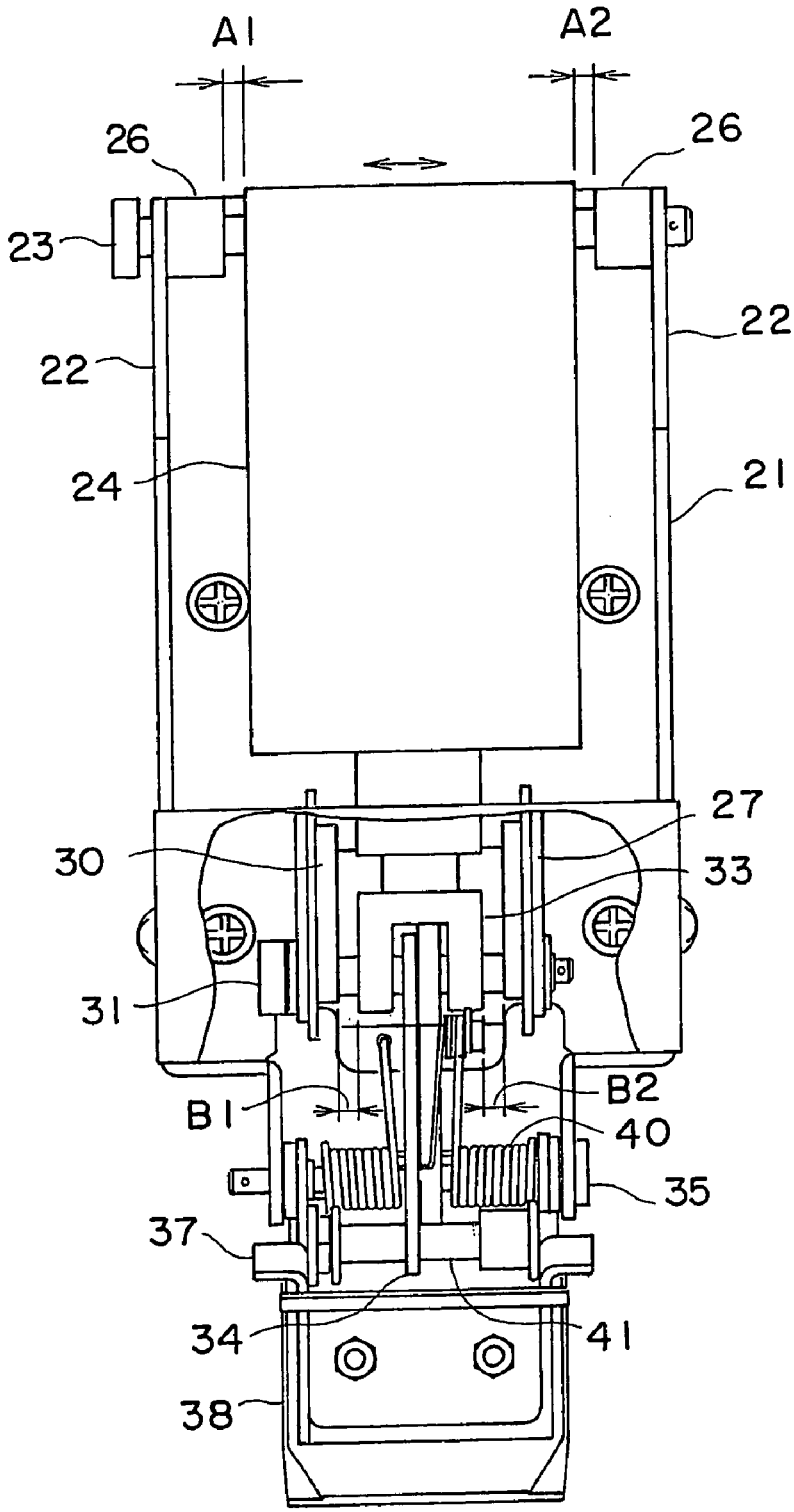
FIG. 2 is a partially cutaway front view showing the ice discharging mechanism of an ice storage box in accordance with the embodiment of the invention.
Figure 3:
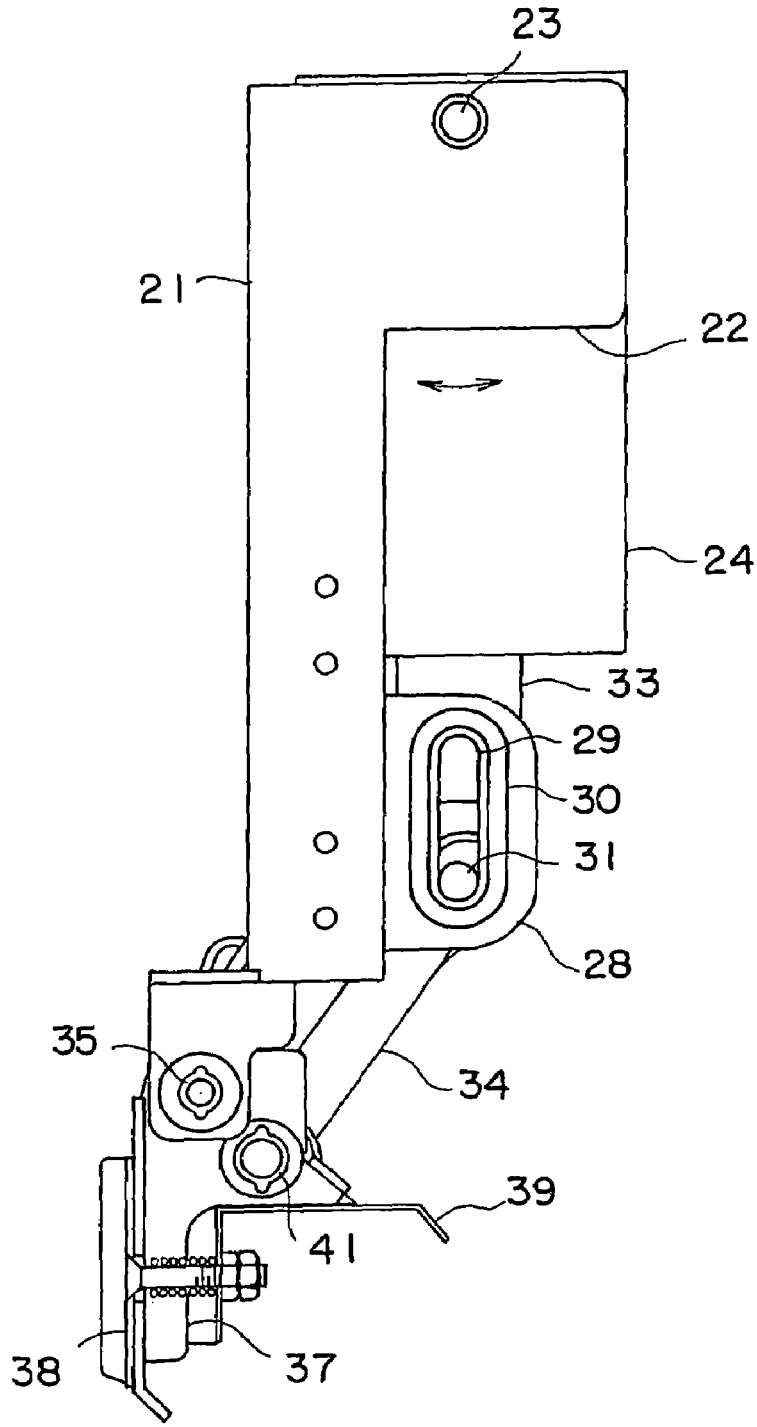
FIG. 3 is a side view showing the ice discharging mechanism of an ice storage box in accordance with the embodiment of the invention.

FIGS. 2 and 3 show partially cutaway front and side views, respectively, of an assembled ice discharging mechanism.

The solenoid 24 is mounted so as to be able to swing about the swing shaft 23 in the forward and backward direction with respect to the bracket 21. Accordingly, even in the case where the axial center of the plunger 33 coupled to the link member 34 by means of the coupling shaft 31 is displaced in the forward and backward direction with respect to the bracket 21 upon assembly of the ice discharging mechanism, the solenoid 24 swings about the swing shaft 23 as appropriate so that the solenoid 24 and the plunger 33 are automatically aligned with each other. Therefore, an overload is prevented from being applied to the solenoid 24 when advancing/retracting the plunger 33, making it possible to perform stable operation as well as to promote extended service life of the mechanism.

Further, the solenoid 24 is adapted to be slidable along the swing shaft 23. Therefore, even in the case where the axial center of the plunger 33 is displaced in the right and left direction with respect to the bracket 21 upon assembly of the ice discharging mechanism, the solenoid 24 slides along the swing shaft 23 as appropriate so that the solenoid 24 and the plunger 33 are automatically aligned with each other, thus preventing an overload from being applied to the solenoid 24.

In addition, since the spacers 26 are respectively inserted between the solenoid 24 and the pair of arm portions 22 of the bracket 21, the distance that the solenoid 24 can slide along the swing shaft 23 is restricted to A1 to the left and A2 to the right as seen in FIG. 2. It is desirable to set the distances A1 and A2 described above equal to or smaller than B1 and B2, respectively. B1 and B2 are the distances that the plunger 33 can move to the left and to the right, respectively, along the coupling shaft 31 between the pair of arm portions 28 of the support plate 27. Such an arrangement prevents an unnecessary load from being applied to the solenoid 24 when the plunger 33 and the support plate 27 rub against each other upon sliding of the solenoid 24 along the swing shaft 23. Note that, at this time, a predetermined distance A=A1+A2 being the sum of the distances that the solenoid 24 can slide to both the right and left is equal to or smaller than a distance B=B1+B2 being the sum of the distances that the plunger can move to both the right and left.

Figure 4:
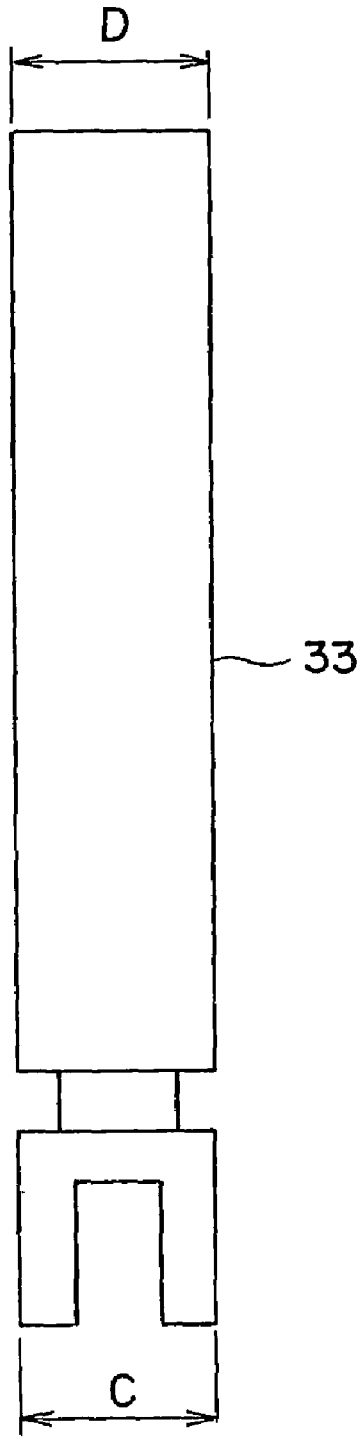
FIG. 4 is a view showing a plunger used in the embodiment of the invention.

Further, as indicated in FIG. 4, it is preferable to form a diameter C of the forward end portion of the plunger 33, which is to be coupled to the link member 34, to be larger than a diameter D of the remaining portion, that is, the main body portion of the plunger 33. Such an arrangement prevents the main body portion of the plunger 33 from running onto the support plate 27 when the solenoid 24 slides along the swing shaft 23.

Figure 5:
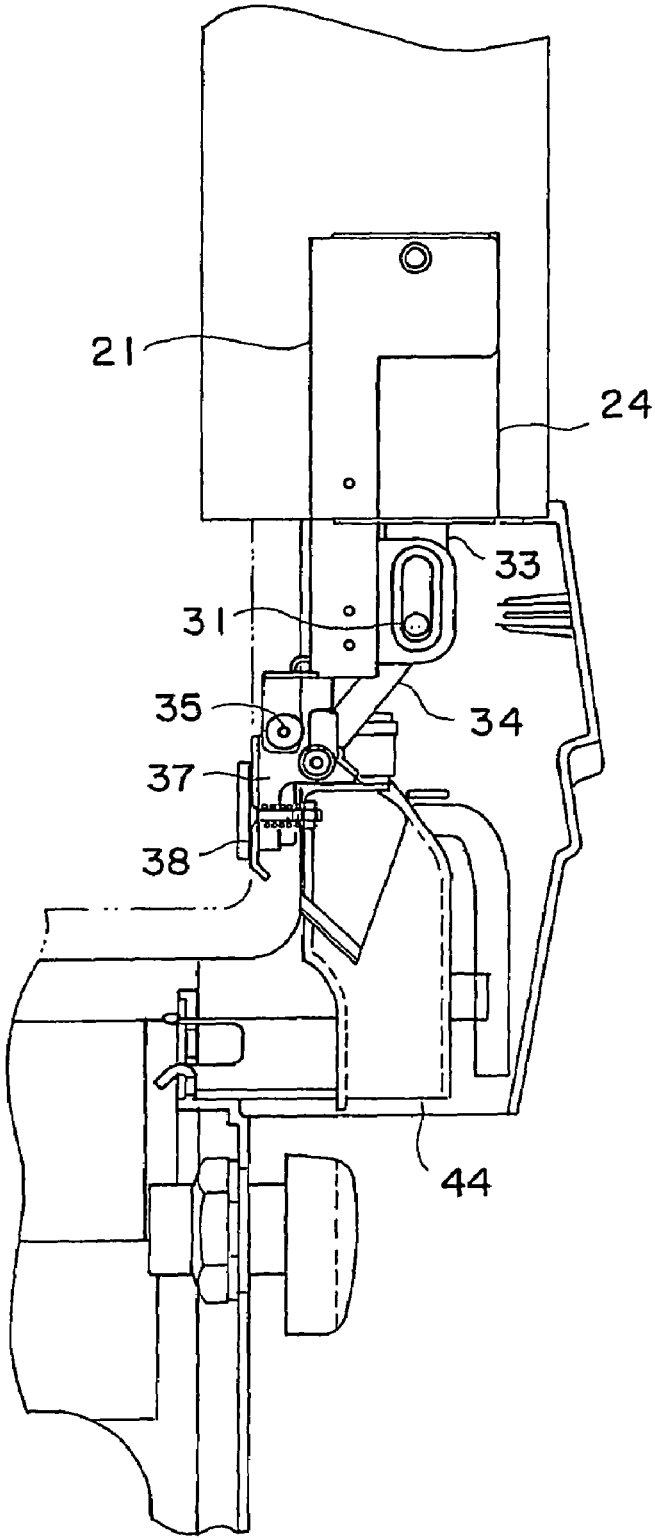
FIG. 5 is a partial sectional view showing an ice storage box incorporating the ice discharging mechanism in accordance with the embodiment of the invention.
Figure 6:
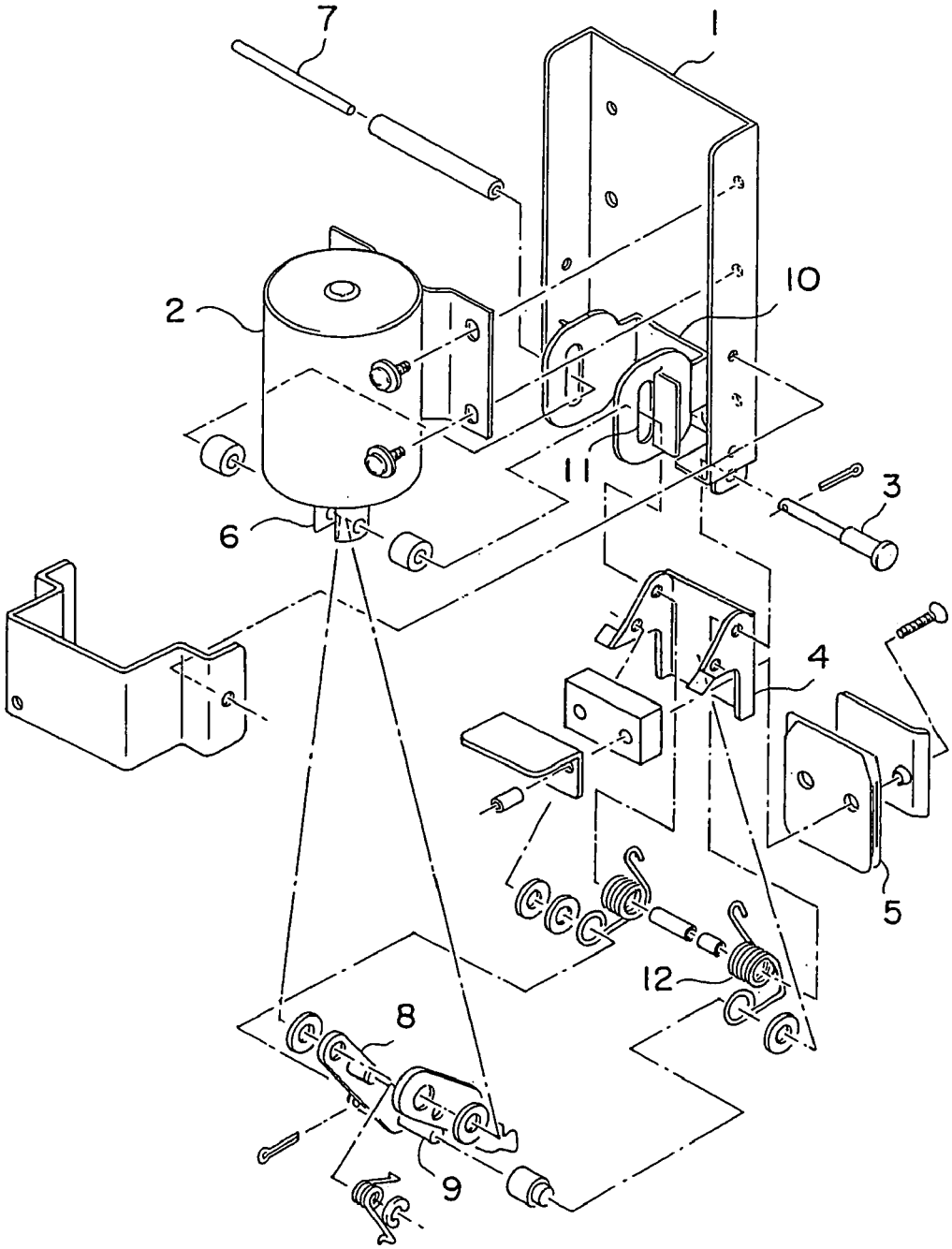
FIG. 6 is an exploded view showing a conventional ice discharging mechanism of an ice storage box.
Figure 7:
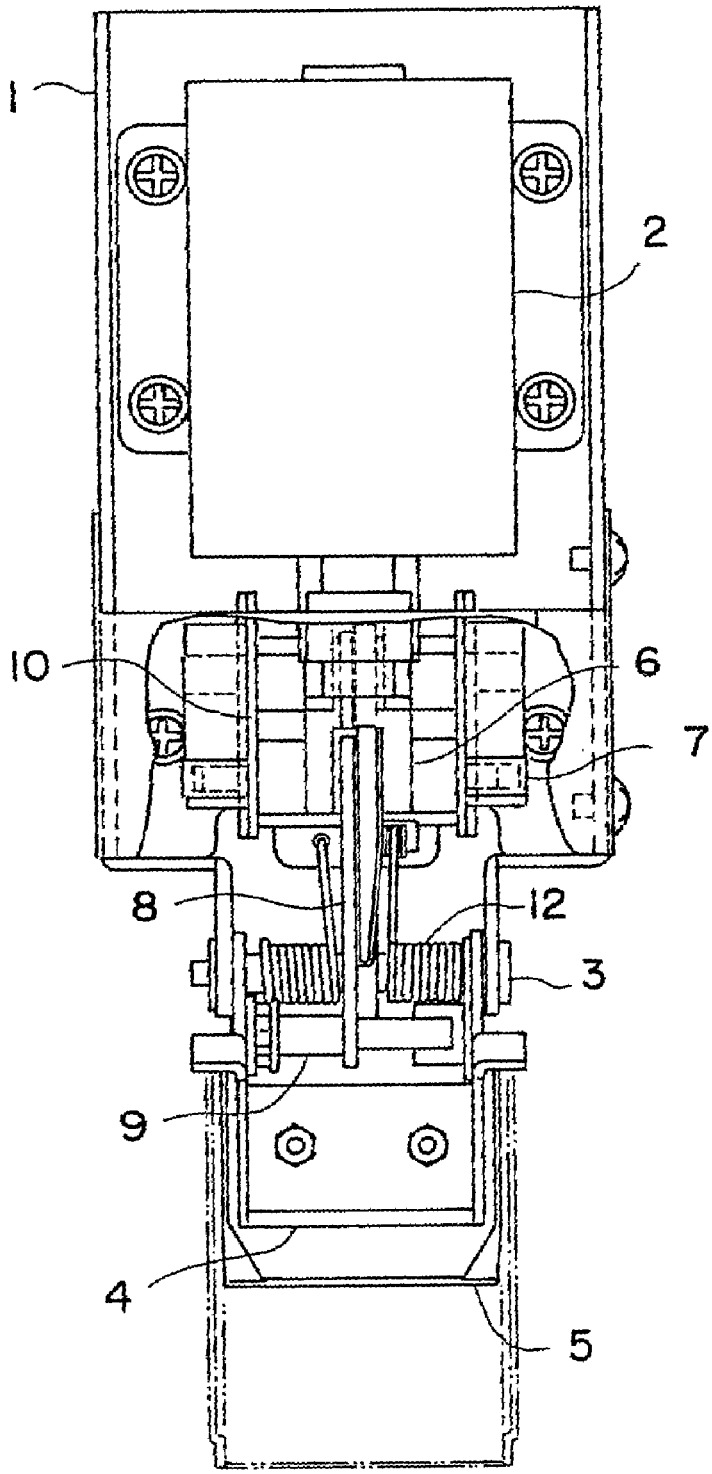
FIG. 7 is a partially cutaway front view showing the ice discharging mechanism of FIG. 6.
Figure 8:
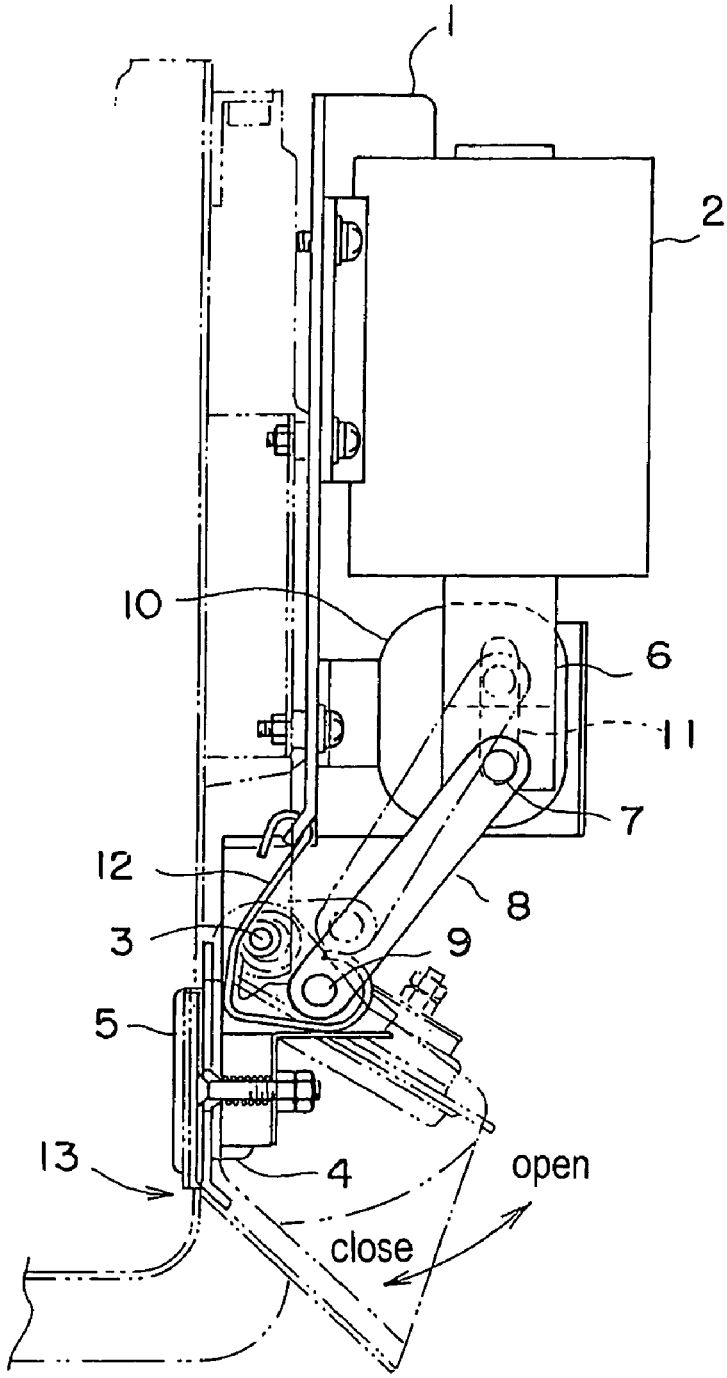
FIG. 8 is a side view showing operation of the ice discharging mechanism of FIG. 6.

FIG. 5 is a partially cutaway view of an ice storage box incorporating the ice discharging mechanism of this embodiment. The operation of the ice discharging mechanism thereof is the same as the operation of the conventional ice discharging mechanism described with reference to FIG. 8. That is, in the extended state of the plunger 33 of the solenoid 24, the pivoting plate 37 is urged by the springs 40 so that the sealing rubber plate 38 plugs the ice discharging port of the ice storage box. When the plunger 33 of the solenoid 24 is contracted, the moving shaft 41 is lifted upward by means of the link member 34 and the pivoting plate 37 is caused to pivot obliquely upward about the fulcrum shaft 35. Thus, the sealing rubber plate 38 is moved apart from the ice discharge port so that the ice discharge port is opened to allow ice within the ice storage box to be discharged and supplied from a supply port 44.

In accordance with such advancing/retracting operation of the plunger 33, the respective members pivot about the swing shaft 23, the coupling shaft 31, the fulcrum shaft 35, and the moving shaft 41 or the coupling shaft 31 slides within the long hole 29. Since the respective members and the coupling shaft 31 are provided with the bearings 25, 30, 36, and 42, the sliding property is improved, thus stabilizing the operation and alleviating wear that occurs due to rubbing of the respective members against each other or rubbing between the respective members and the shafts, as well as promoting extended service life of the mechanism. Further, coating a lubricant onto the surfaces of the springs 40 makes it possible to alleviate wear of the springs 40 as well.

As has been described hereinabove, in accordance with the present invention, the swing shaft is provided to the bracket and the swinging solenoid is mounted on the bracket, whereby even in the case where the axial center of the plunger is displaced upon assembly of the ice discharging mechanism, the solenoid swings about the swing shaft as appropriate, thereby allowing the solenoid and the plunger to be automatically aligned with each other. As a result, an overload is prevented from being applied to the solenoid, making it possible to achieve a stable operation and to promote extended service life of the mechanism.

The invention claimed is:

1. An ice discharging mechanism of an ice storage box, comprising:

a bracket fixed near an ice discharge port of the ice storage box;

an opening/closing door pivotably mounted to the bracket;

a swing shaft mounted to the bracket; and a swinging solenoid mounted to the swing shaft and having a plunger that is capable of advancing/retracting, the solenoid rotating the opening/closing door by means of the advancing/retracting operation of the plunger to selectively open/close the ice discharge port of the ice storage box, wherein the solenoid is mounted so as to be slidable by a predetermined distance along an axial direction of the swing shaft.

2. An ice discharging mechanism of an ice storage box according to claim 1, further comprising:

a link member for connecting a forward end portion of the plunger to the opening/closing door; and a support plate fixed to the bracket and slidably supporting a coupling shaft that couples the forward end portion of the plunger to the link member, the predetermined distance being equal to or smaller than a distance that the plunger can move along the coupling shaft.

3. An ice discharging mechanism of an ice storage box according to claim 2, wherein a diameter of the forward end portion of the plunger which is to be coupled to the link member is larger than a diameter of a remaining portion of the plunger.

4. An ice discharging mechanism of an ice storage box according to claim 2, further comprising a cover member for covering a front portion of the support plate.

5. An ice discharging mechanism of an ice storage box according to claim 1, wherein the opening/closing door includes a pivoting plate that is pivotably mounted to the bracket and a sealing rubber plate fixed to the pivoting plate for plugging the ice discharge port of the ice storage box.

6. An ice discharging mechanism of an ice storage box according to claim 5, further comprising a spring for urging the pivoting plate such that the sealing rubber plate plugs the ice discharge port of the ice storage box.

* * * * *